US011311986B2

(12) United States Patent
Liu

(10) Patent No.: US 11,311,986 B2
(45) Date of Patent: Apr. 26, 2022

(54) SCREWDRIVER ROTATION STRUCTURE

(71) Applicant: Ningbo King Mount Co., Ltd., Ningbo (CN)

(72) Inventor: Kuan-Ting Liu, Taichung (TW)

(73) Assignee: Ningbo King Mount Co., Ltd., Ningbo (CN)

( * ) Notice: Subject to any disclaimer, the term of this patent is extended or adjusted under 35 U.S.C. 154(b) by 217 days.

(21) Appl. No.: 15/930,623

(22) Filed: May 13, 2020

(65) Prior Publication Data

US 2021/0354272 A1 Nov. 18, 2021

(51) Int. Cl.
*B25B 15/04* (2006.01)
*B25B 23/00* (2006.01)

(52) U.S. Cl.
CPC ..... *B25B 15/04* (2013.01); *B25B 23/0035* (2013.01)

(58) Field of Classification Search
CPC ..... B25B 15/04; B25B 23/0035
USPC ..... 81/59.1
See application file for complete search history.

(56) References Cited

U.S. PATENT DOCUMENTS 4,669,339 A * 6/1987 Cartwright ..... B25B 13/462 81/59.1
6,112,624 A * 9/2000 Chen ..... B25B 13/462 81/59.1
9,296,093 B2 3/2016 Ross

* cited by examiner

*Primary Examiner* — Hadi Shakeri
(74) *Attorney, Agent, or Firm* — Karin L. Williams; Alan D. Kamrath; Mayer & Williams PC

(57) ABSTRACT

A screwdriver rotation structure includes a main body, a control member, a driving member, multiple first rolls, and multiple second rolls. The main body has multiple first recesses and multiple first pillars. Each of the first recesses has a first face. Each of the first pillars has two second faces, two third faces, and a first pivot portion. The main body has multiple second pivot portions. The control member has multiple third pivot portions and multiple second pillars. Each of the second pillars has a fourth face, a fifth face, and a fourth pivot portion. The control member has a fifth pivot portion and a mounting portion. Each of the first rolls is received in one of the first recesses. Each of the second rolls is received in one of the first recesses.

7 Claims, 8 Drawing Sheets

SCREWDRIVER ROTATION STRUCTURE

BACKGROUND OF THE INVENTION

1. Field of the Invention

The present invention relates to a hand tool and, more particularly, to a screwdriver rotation structure.

2. Description of the Related Art

A conventional screwdriver rotation structure or reversible ratchet tool was disclosed in the applicant's U.S. Pat. No. 9,296,093, and comprises a ratchet body 102, a cage member 108 fit and disposed within the ratchet body 102, a reverser sleeve 116 sized to fit coaxially disposed within the cage member 108, and a drive member 104 including an axle portion 105 sized to be rotatably contained by the reverser sleeve 116. The ratchet body 102 includes an inner surface 118 defining an inner wall of a circular aperture 120. The cage member 108 is mounted in the ratchet body 102 and includes an annular base 122 and a plurality of axial fingers 124 extending from one side of the annular base 122. The annular base 122 is fit and coaxially disposed within the circular aperture 120, wherein the fingers 124 substantially avoids contact with the inner surface 118, to cooperatively define a cage aperture 126. A tab 134 extends radially from the annular base 122 into the cage aperture 126. A number of rollers 106 are constrained by the cage member 108 between an inner surface 118 of the ratchet body 102 and the drive member 104. A pair of compression springs 110, 111 are mounted between the reverser sleeve 116 and the cage member 108. The characteristics of the present disclosure is in that, the drive member 104 and the reverser sleeve 116 are selectively constrained in either of a first angular displacement or a second angular displacement relative to each other.

The conventional screwdriver rotation structure has the following disadvantages.

1. When the drive member 104 and the reverser sleeve 116 are switched from the first angular displacement to the second angular displacement, the cage member 108 switches the rollers 106 from the first position to the second position corresponding to the drive member 104. Thus, the cage member 108 only switches the rollers 106 relative to the drive member 104 to the first position or the second position. In such a manner, the rollers 106 is located at two positions relative to the drive member 104, such that the drive member 104 and the reverser sleeve 116 are limited to the first angular displacement or the second angular displacement, and the drive member 104 is limited to rotate relative to the ratchet body 102 clockwise or counterclockwise. Thus, the conventional screwdriver rotation structure only has two rotation modes that are limited to a clockwise rotation or a counterclockwise rotation, thereby causing inconvenience to the user in operation of the conventional screwdriver rotation structure.

2. The conventional screwdriver rotation structure contains a direction switching structure having six elements, including the cage member 108, the compression springs 110, the compression springs 111, the detent spring 112, the braking ball 114, and the reverser sleeve 116, to move and position the rollers 106, such that the direction switching structure is complicated, thereby increasing the cost of production.

BRIEF SUMMARY OF THE INVENTION

In accordance with the present invention, there is provided a screwdriver rotation structure comprising a main body, a control member, a driving member, a plurality of first rolls, and a plurality of second rolls. The main body is provided with a plurality of first recesses and a plurality of first pillars. Each of the first recesses has a first face. Each of the first pillars has two second faces, two third faces, and a first pivot portion. The main body is provided with a plurality of second pivot portions. The control member is provided with a plurality of third pivot portions and a plurality of second pillars. Each of the second pillars has a fourth face, a fifth face, and a fourth pivot portion. The control member is provided with a fifth pivot portion and a mounting portion. Each of the first rolls is received in one of the first recesses. Each of the second rolls is received in one of the first recesses.

According to the primary advantage of the present invention, the control member is rotated on the main body, such that the driving member is driven by the main body to rotate in the anticlockwise direction only, in the clockwise direction only, and in the clockwise and anticlockwise directions, to perform three operation modes, thereby facilitating the user operating the screwdriver rotation structure. In addition, when the second pillars are detached and spaced from the first rolls and the second rolls, the first rolls and the second rolls are located between the first face and the peripheral face of the fifth pivot portion, such that the control member is located at a position where the main body and the driving member cannot idle. Thus, the driving member is driven by the main body to rotate in the clockwise and anticlockwise directions.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
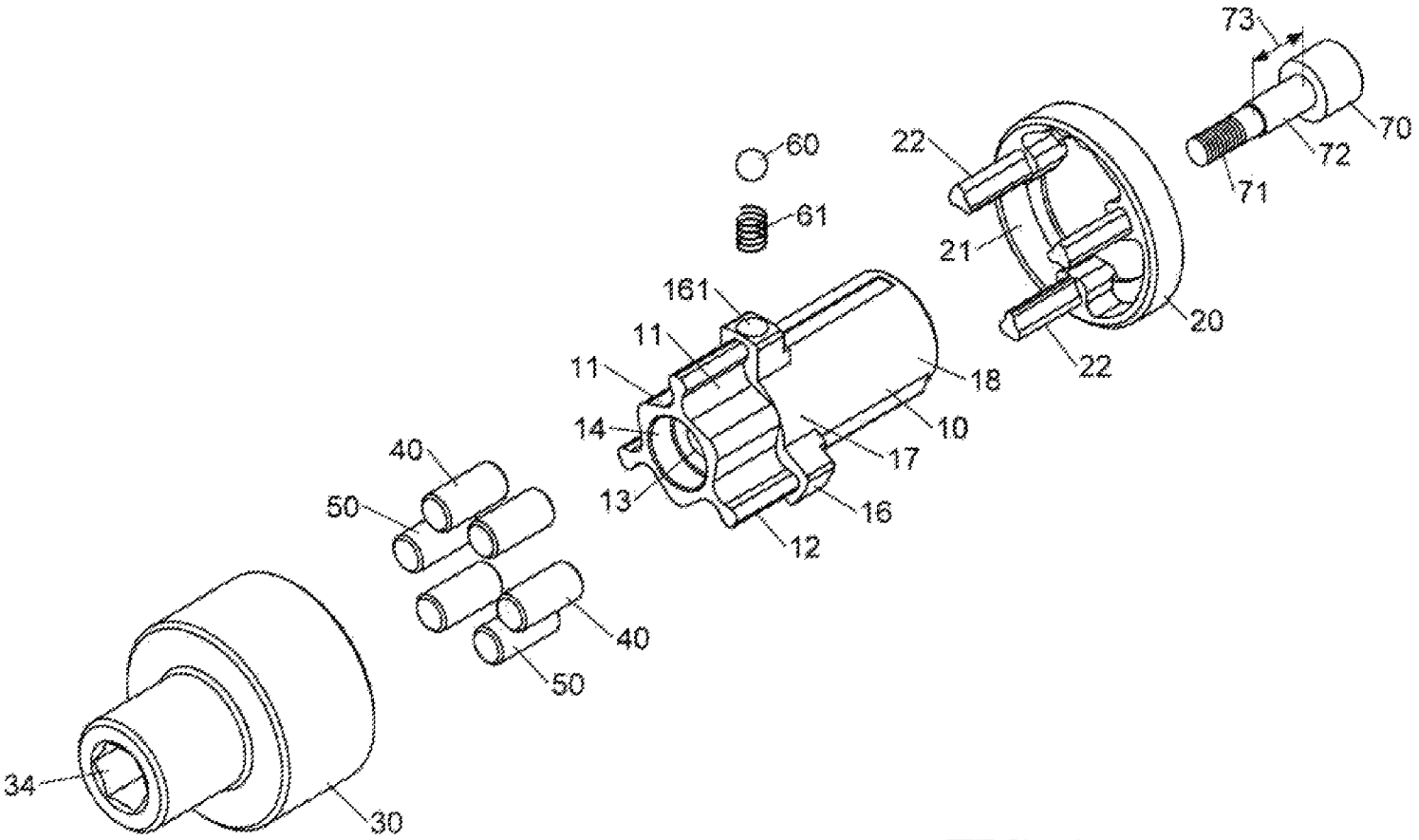
FIG. 1 is an exploded perspective view of a screwdriver rotation structure in accordance with the preferred embodiment of the present invention.
Figure 3:
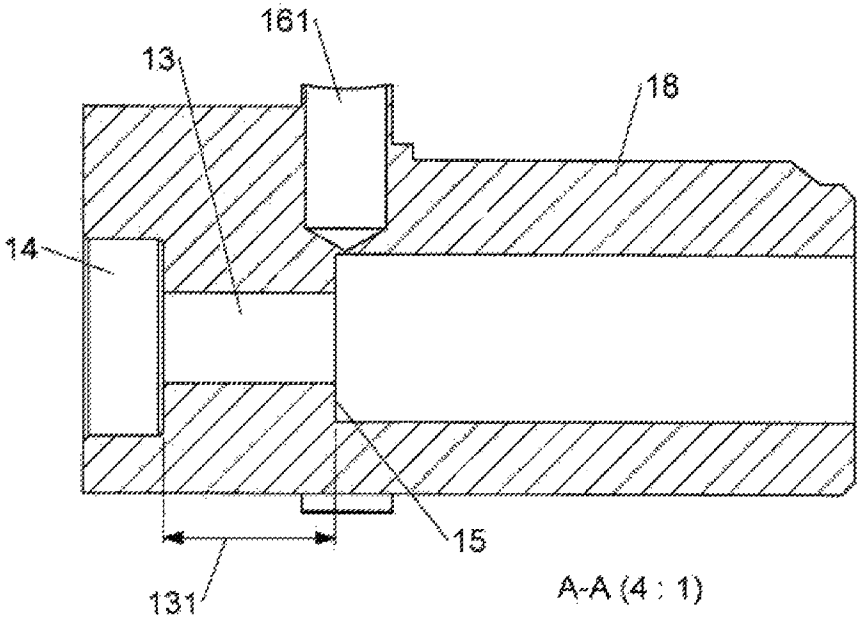
FIG. 3 is a cross-sectional view of the main body of the screwdriver rotation structure taken along line A-A as shown in FIG. 2.
Figure 2:
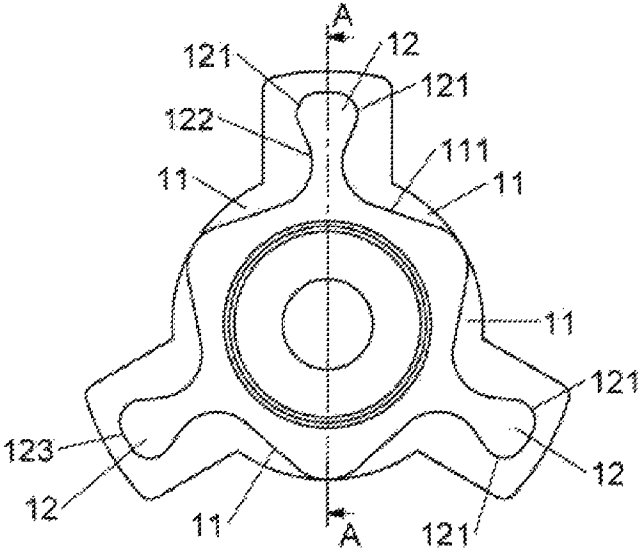
FIG. 2 is a front view of a main body of the screwdriver rotation structure in accordance with the preferred embodiment of the present invention.
Figure 5:
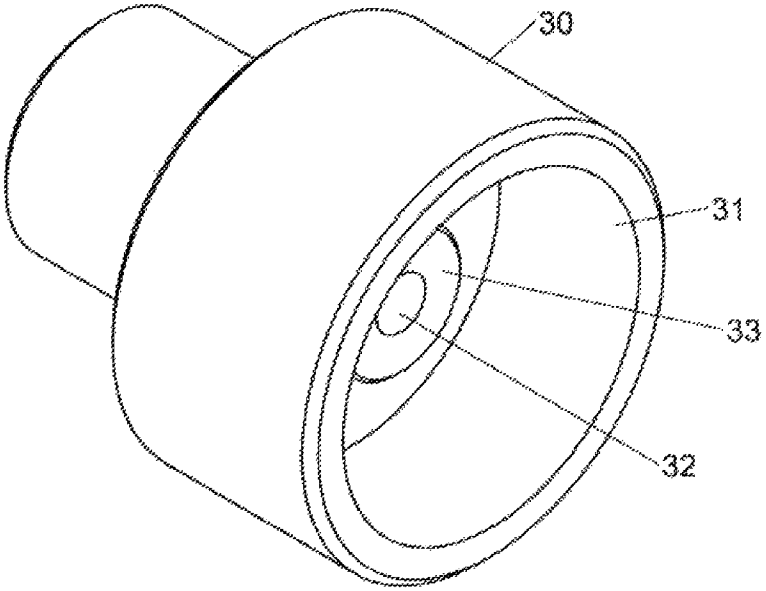
FIG. 5 is a perspective view of a driving member of the screwdriver rotation structure in accordance with the preferred embodiment of the present invention.
Figure 4:
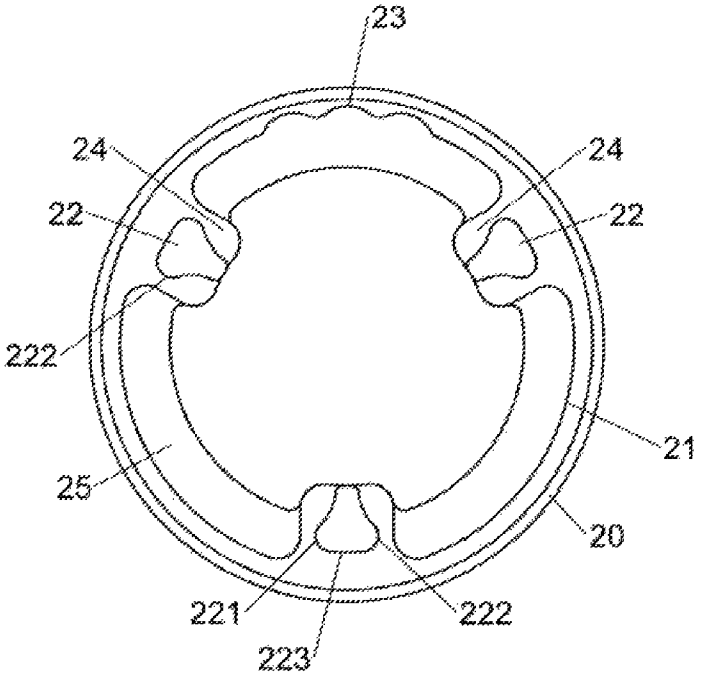
FIG. 4 is a front view of a control member of the screwdriver rotation structure in accordance with the preferred embodiment of the present invention.
Figure 6:
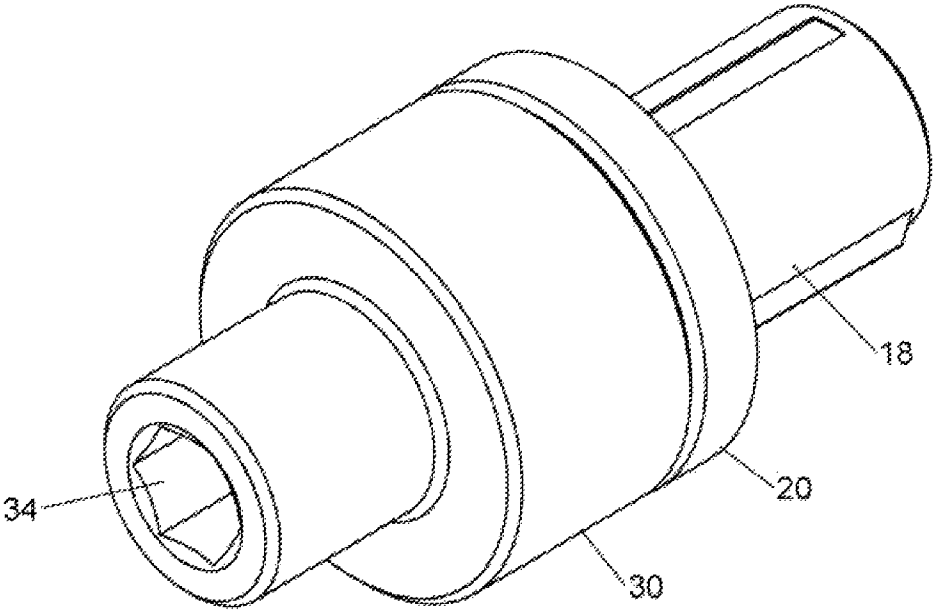
FIG. 6 is a perspective view of the screwdriver rotation structure in accordance with the preferred embodiment of the present invention.
Figure 8:
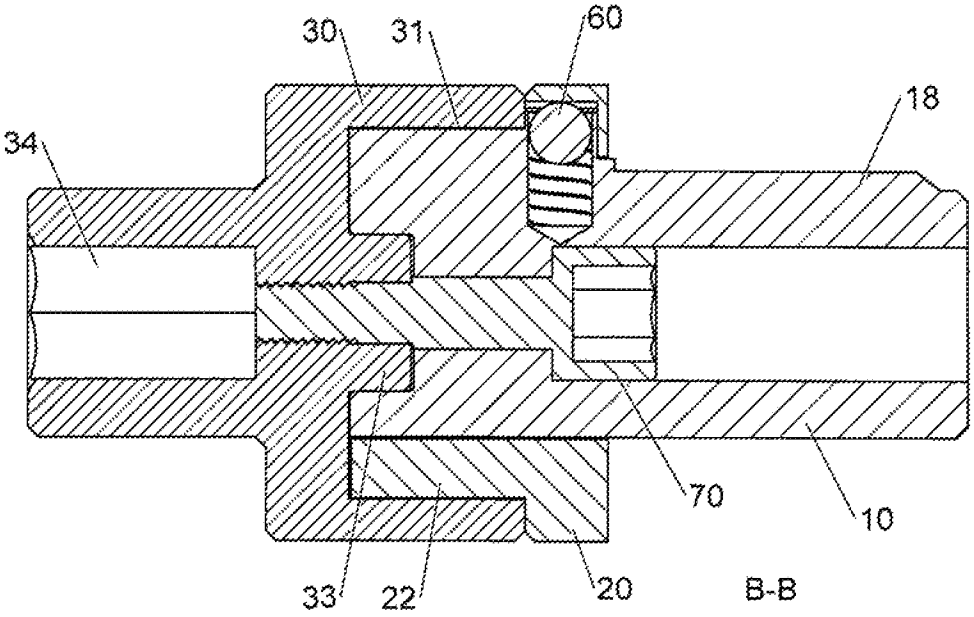
FIG. 8 is a cross-sectional view of the main body of the screwdriver rotation structure taken along line B-B as shown in FIG. 7.
Figure 7:
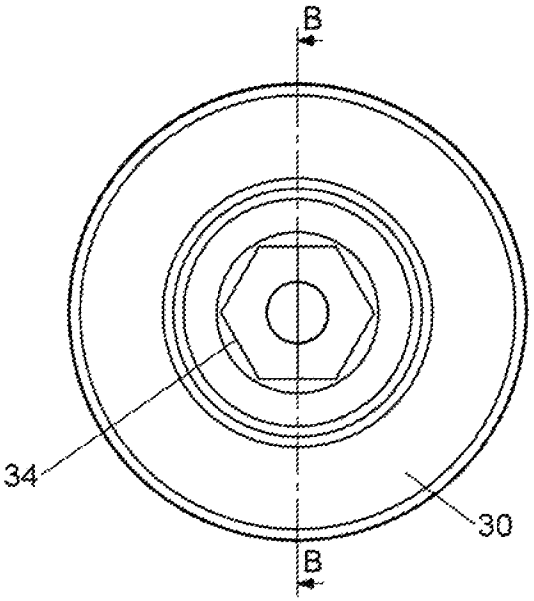
FIG. 7 is a front view of the screwdriver rotation structure as shown in FIG. 6.

Referring to the drawings and initially to FIGS. 1-10, a screwdriver rotation structure in accordance with the preferred embodiment of the present invention comprises a main body 10, a control member 20, a driving member 30, a plurality of first rolls 40, a plurality of second rolls 50, a ball 60, an elastic member 61, and a screw member 70.

The main body 10 has a front end provided with a plurality of first recesses 11 and a plurality of first pillars 12. The first recesses 11 and the first pillars 12 are spaced and arranged annularly about an axis of the main body 10. The first recesses 11 are arranged between the first pillars 12, and have a number doubling that of the first pillars 12.

Each of the first recesses 11 has a first face 111 having an arcuate shape or a planar shape. Each of the first pillars 12 has two second faces 121 which are distant from the first face 111 and are arranged symmetrically. Each of the two second faces 121 has an arcuate shape. Each of the first pillars 12 has two third faces 122 which are arranged symmetrically. Each of the two third faces 122 is located at a connection of each of the first pillars 12 and each of the first recesses 11. Each of the two third faces 122 connects each of the two second faces 121 and is located between each of the two second faces 121 and the first face 111. Each of the two third faces 122 has an arcuate shape. Each of the first pillars 12 is provided with a first pivot portion 123 which is located between the two second faces 121. The first pivot portion 123 of each of the first pillars 12 has an arcuate face having an axis coinciding with that of the main body 10.

The main body 10 has an interior provided with a through hole 13 which has a circular shape and has a first length 131. The through hole 13 has a first end provided with a first fitting portion 14 and a second end provided with a first abutting portion 15. The first fitting portion 14 has an opening located at a front end face of the main body 10. The first fitting portion 14 is connected to the through hole 13 and has a diameter greater than that of the through hole 13. The through hole 13 is located between the first fitting portion 14 and the first abutting portion 15. The first abutting portion 15 has a planar shape. The main body 10 is provided with a plurality of second pivot portions 16 located at a middle thereof. The second pivot portions 16 are spaced and arranged annularly about the axis of the main body 10. Each of the first pillars 12 extends from each of the second pivot portions 16 toward the front end face of the main body 10. The second pivot portions 16 have a number equal to that of the first pillars 12. Each of the second pivot portions 16 is a protruding block and has a diameter greater than that of the first pivot portion 123. The second pivot portions 16 have an axis coinciding with that of the main body 10. One of the second pivot portions 16 is provided with a receiving space 161 having a circular shape. The main body 10 is provided with a plurality of second recesses 17 each of which is arranged between two of the second pivot portions 16 and aligns with two of the first recesses 11 respectively. The second pivot portions 16 and the second recesses 17 are spaced and arranged annularly.

The control member 20 is pivotally mounted on and rotatable relative to the main body 10. The control member 20 is provided with a plurality of third pivot portions 21 which are pivotally mounted on and rotatable relative to the second pivot portions 16. The third pivot portions 21 are spaced and arranged annularly, and have a number equal to that of the first pillars 12. Each of the third pivot portions 21 is a groove having an opening facing the first recesses 11. The control member 20 is provided with a plurality of second pillars 22 each movable between two of the first recesses 11. Each of the second pillars 22 is arranged between two of the third pivot portions 21. The third pivot portions 21 and the second pillars 22 are spaced and arranged annularly about an axis of the control member 20. The second pillars 22 have a number equal to that of the first pillars 12.

Each of the second pillars 22 has a fourth face 221, a fifth face 222, and a fourth pivot portion 223. The fourth face 221 is distant from the fifth face 222. The fourth face 221 and the fifth face 222 are arranged symmetrically relative to each of the second pillars 22 and have a convex shape. The fourth pivot portion 223 is located between the fourth face 221 and the fifth face 222. The fourth pivot portion 223 has an arcuate shape and has a diameter equal to that of the first pivot portion 123.

The control member 20 is provided with a plurality of positioning grooves 23, with the receiving space 161 aligning with one of the positioning grooves 23 when the control member 20 is rotated relative to the main body 10. The control member 20 has three positioning grooves 23. The positioning grooves 23 are spaced and connected to one of the third pivot portions 21. The control member 20 is provided with a plurality of projections 24 received in the second recesses 17, such that the projections 24 and the second recesses 17 restrict the maximum rotation degree of the control member 20 relative to the main body 10. Each of the projections 24 is located between two of the third pivot portions 21. Each of the second pillars 22 extends from each of the projections 24 toward the first recesses 11. The projections 24 have a number equal to that of the second pillars 22. The control member 20 is provided with a second abutting portion 25 abutting the second pivot portions 16.

The driving member 30 is pivotally mounted on the main body 10. The driving member 30 has a first end provided with a fifth pivot portion 31 and a second end provided with a mounting portion 34. The fifth pivot portion 31 has a circular shape and aligns with the first recesses 11. The first pillars 12 are pivotally mounted in the fifth pivot portion 31. The fifth pivot portion 31 partially receives the main body 10 and is pivotally mounted on the first pivot portion 123 and the fourth pivot portion 223. The fifth pivot portion 31 has an opening facing the control member 20. The driving member 30 is provided with a first screw portion 32 connected to the fifth pivot portion 31 and aligning with the through hole 13. The first screw portion 32 is an internal thread. The driving member 30 is provided with a second fitting portion 33 pivotally mounted in the first fitting portion 14. The second fitting portion 33 has a cylindrical shape and protrudes from a bottom of the fifth pivot portion 31. The first screw portion 32 is formed in the second fitting portion 33. The mounting portion 34 is distant from the fifth pivot portion 31 and is connected to the first screw portion 32. The first screw portion 32 is located between the fifth pivot portion 31 and the mounting portion 34. The mounting portion 34 is a polygonal recess.

Each of the first rolls 40 is received in one of the first recesses 11, and pivotally arranged between one of the first pillars 12 and one of the second pillars 22. The first rolls 40 are pivotally mounted in the fifth pivot portion 31 and have a number equal to that of the first pillars 12. Each of the first rolls 40 has a cylindrical shape and rests between the first face 111 and a peripheral face of the fifth pivot portion 31. Each of the first rolls 40 is movable between one of the two second faces 121 and the fourth face 221.

Each of the second rolls 50 is received in one of the first recesses 11, and pivotally arranged between one of the first pillars 12 and one of the second pillars 22. Each of the first rolls 40 and each of the second rolls 50 are arranged between two of the first pillars 12. Each of the second pillars 22 is arranged between one of the first rolls 40 and one of the second rolls 50. The second rolls 50 are pivotally mounted in the fifth pivot portion 31. The first pillars 12, the first rolls 40, the second pillars 22, and the second rolls 50 are spaced and arranged annularly in the fifth pivot portion 31. Each of the second rolls 50 has a cylindrical shape and rests between the first face 111 and the peripheral face of the fifth pivot portion 31. Each of the second rolls 50 is movable between one of the two second faces 121 and the fifth face 222. Each of the second rolls 50 has a structure the same as that of each of the first rolls 40. The second rolls 50 have a number equal to that of the first pillars 12 and that of the first rolls 40.

When the second pillars 22 are spaced from the first rolls 40 and the second rolls 50, the main body 10 rotates the driving member 30 clockwise and anticlockwise. When the control member 20 is rotated relative to the main body 10 to press the first rolls 40 or the second rolls 50, the main body 10 rotates the driving member 30 clockwise or anticlockwise. Thus, the screwdriver rotation structure includes three rotating modes.

When the control member 20 is rotated relative to the main body 10 anticlockwise, the fourth face 221 is moved to press each of the first rolls 40, such that each of the first rolls 40 is limited by each of the second pillars 22 and rests on one of the two second faces 121, such that each of the first rolls 40 is detached from the peripheral face of the fifth pivot portion 31 with a gap being formed therebetween. In such a manner, when the main body 10 is rotated clockwise, the second rolls 50 are driven by the main body 10 to drive and rotate the driving member 30 clockwise. On the contrary, when the main body 10 is rotated anticlockwise, the first rolls 40 are driven by the main body 10, but cannot drive the driving member 30, such that the main body 10 idles anticlockwise.

When the control member 20 is rotated relative to the main body 10 clockwise, the fifth face 222 is moved to press each of the second rolls 50, such that each of the second rolls 50 is limited by each of the second pillars 22 and rests on one of the two second faces 121, such that each of the second rolls 50 is detached from the peripheral face of the fifth pivot portion 31 with a gap being formed therebetween. In such a manner, when the main body 10 is rotated anticlockwise, the first rolls 40 are driven by the main body 10 to drive and rotate the driving member 30 anticlockwise. On the contrary, when the main body 10 is rotated clockwise, the second rolls 50 are driven by the main body 10, but cannot drive the driving member 30, such that the main body 10 idles clockwise.

The ball 60 is received in the receiving space 161 and positioned in one of the positioning grooves 23. Thus, when the control member 20 is rotated relative to the main body 10, the ball 60 is positioned in one of the positioning grooves 23, such that the second pillars 22 presses the first rolls 40 (see FIG. 11), or presses the second rolls 50 (see FIG. 13), or detach from the first rolls 40 and the second rolls 50 (see FIG. 10). In such a manner, the driving member 30 is driven by the main body 10 in the anticlockwise direction only, in the clockwise direction only, and in the clockwise and anticlockwise directions.

The elastic member 61 is received in the receiving space 161 and biased between the receiving space 161 and the ball 60, such that the ball 60 partially protrudes from the receiving space 161. The elastic member 61 is preferably a spring structure.

The screw member 70 extends through the through hole 13 and has a first end provided with a second screw portion 71 and a second end provided with a head. The second screw portion 71 is an external thread that is screwed with the first screw portion 32, such that the main body 10 and the driving member 30 are connected without detachment. The screw member 70 has a shank 72 extending through the through hole 13. The shank 72 is a round pole (or rod) and is located between the head and the second screw portion 71. The shank 72 has a second length 73 that is slightly greater than the first length 131. The head of the screw member 70 rests on the first abutting portion 15.

In the preferred embodiment of the present invention, the main body 10 has six first recesses 11 and three first pillars 12, and the control member 20 has three third pivot portions 21 and three second pillars 22.

In the preferred embodiment of the present invention, the main body 10 has a rear end provided with an assembly portion 18 for mounting a handle.

In the preferred embodiment of the present invention, the driving member 30 is pivotally mounted on the main body 10 and the control member 20.

In the preferred embodiment of the present invention, the screwdriver rotation structure has three first rolls 40.

In the preferred embodiment of the present invention, the screwdriver rotation structure has three second rolls 50.

In another preferred embodiment of the present invention, each of the first rolls 40 is a round bead. Each of the first recesses 11 is provided with two of the first rolls 40 that are arranged linearly. Each of the second rolls 50 is a round bead. Each of the first recesses 11 is provided with two of the second rolls 50 that are arranged linearly.

In assembly, the control member 20 is pivotally mounted on and rotatable relative to the main body 10. The driving member 30 is pivotally mounted on the main body 10. The first pillars 12 are pivotally mounted in the fifth pivot portion 31. The second pillars 22 are pivotally mounted in the fifth pivot portion 31. The first rolls 40 and the second rolls 50 are received in the first recesses 11 and the fifth pivot portion 31. The ball 60 and the elastic member 61 are received in the receiving space 161. The ball 60 partially protrudes from the receiving space 161 and is positioned in one of the positioning grooves 23, such that the control member 20 is located at three positions where the driving member 30 is driven by the main body 10 to rotate in the anticlockwise direction only, in the clockwise direction only, and in the clockwise and anticlockwise directions. The screw member 70 extends through the through hole 13 and is screwed with the first screw portion 32, such that the main body 10 and the driving member 30 are connected pivotally.

Figure 9:
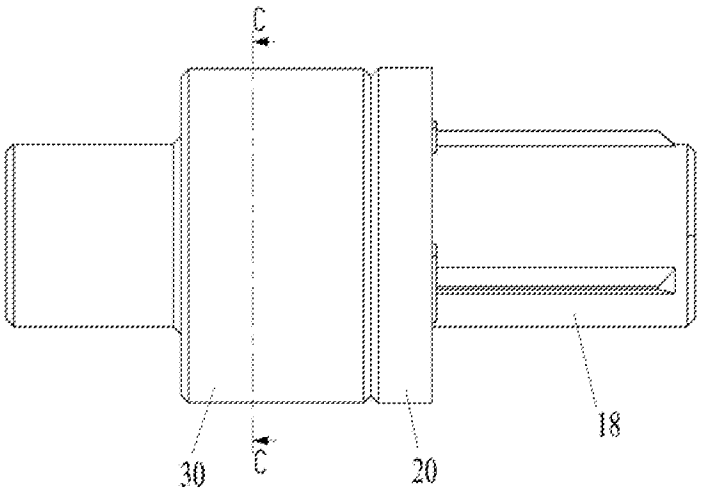
FIG. 9 is a front view of the screwdriver rotation structure as shown in FIG. 6.
Figure 10:
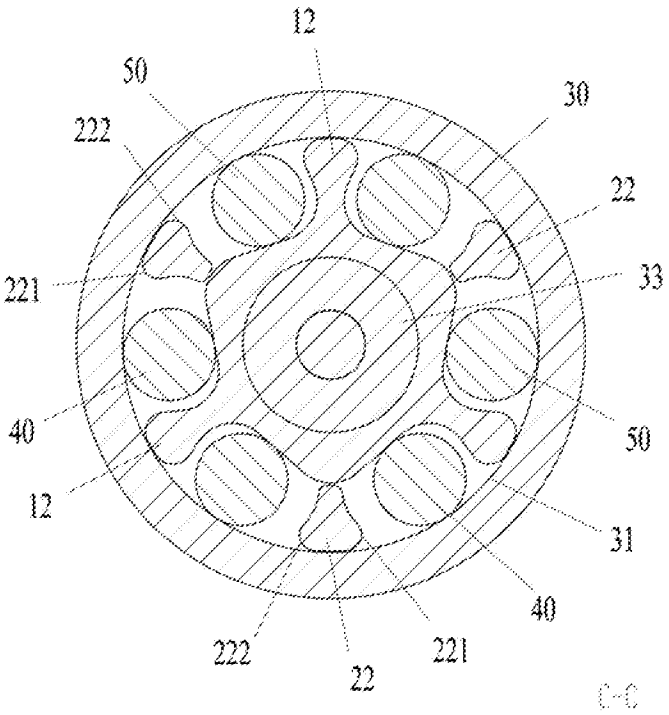
FIG. 10 is a cross-sectional view of the main body of the screwdriver rotation structure taken along line C-C as shown in FIG. 9, showing a first operation mode.

Referring to FIGS. 9 and 10 with reference to FIGS. 1-8, when the ball 60 is positioned in one of the positioning grooves 23, the second pillars 22 are detached and spaced from the first rolls 40 and the second rolls 50, such that the driving member 30 is driven by the main body 10 to rotate in the clockwise and anticlockwise directions.

Figure 11:
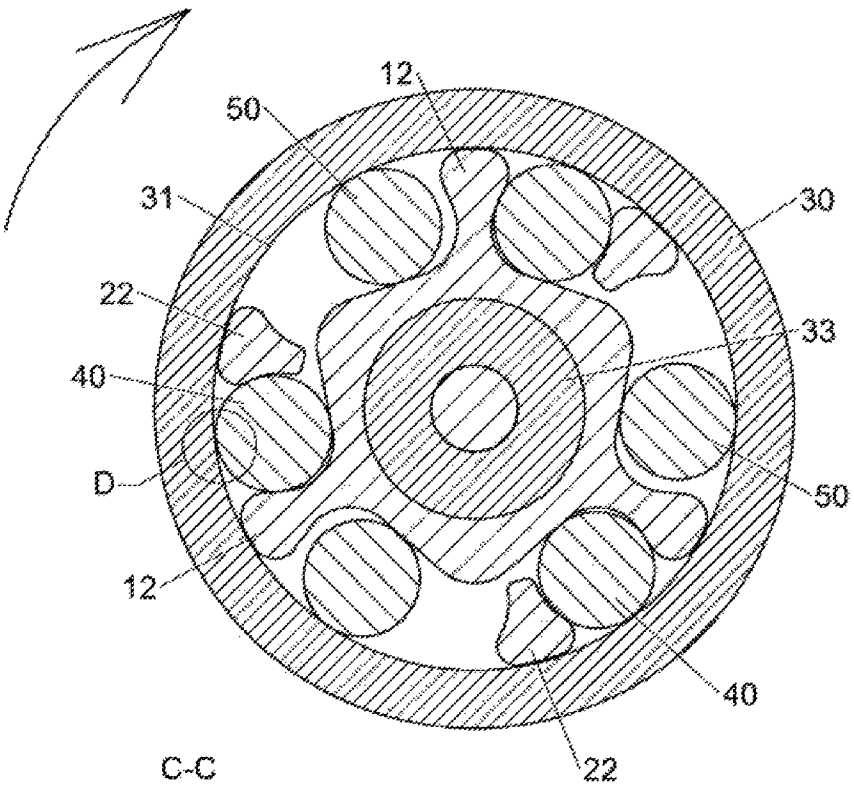
FIG. 11 is a schematic operational view of the screwdriver rotation structure as shown in FIG. 10, showing a second operation mode.
Figure 12:
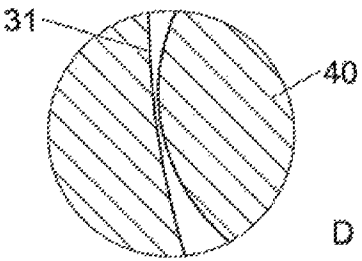
FIG. 12 is a locally enlarged view of the screwdriver rotation structure taken along mark "D" as shown in FIG. 11.

Referring to FIGS. 11 and 12 with reference to FIGS. 1-10, when the control member 20 is rotated relative to the main body 10 anticlockwise, the fourth face 221 is moved to press each of the first rolls 40, such that each of the first rolls 40 is limited by each of the second pillars 22 and rests on one of the two second faces 121 and one of the two third faces 122, such that each of the first rolls 40 is detached from the peripheral face of the fifth pivot portion 31 with a gap being formed therebetween as shown in FIG. 12. In such a manner, when the main body 10 is rotated clockwise, the second rolls 50 are driven by the main body 10 to drive and rotate the driving member 30 clockwise. On the contrary, when the main body 10 is rotated anticlockwise, the first rolls 40 are driven by the main body 10, but cannot drive the driving member 30, such that the main body 10 idles anticlockwise.

Figure 13:
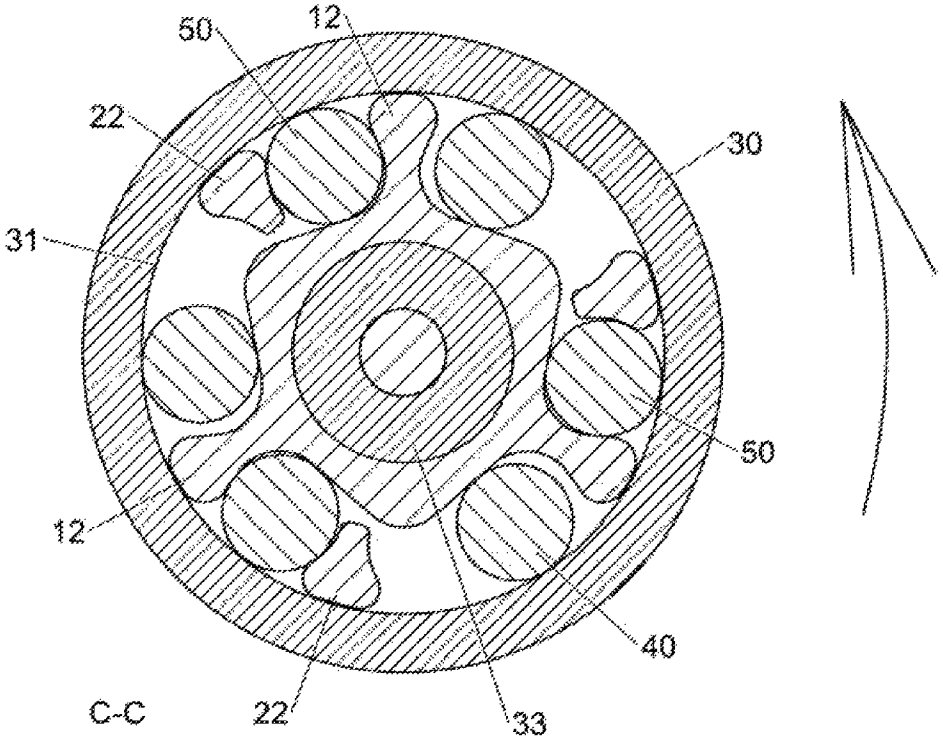
FIG. 13 is a schematic operational view of the screwdriver rotation structure as shown in FIG. 10, showing a third operation mode.

Referring to FIG. 13 with reference to FIGS. 1-12, when the control member 20 is rotated relative to the main body 10 clockwise, the fifth face 222 is moved to press each of the second rolls 50, such that each of the second rolls 50 is limited by each of the second pillars 22 and rests on one of the two second faces 121 and one of the two third faces 122, such that each of the second rolls 50 is detached from the peripheral face of the fifth pivot portion 31 with a gap being formed therebetween. In such a manner, when the main body 10 is rotated anticlockwise, the first rolls 40 are driven by the main body 10 to drive and rotate the driving member 30 anticlockwise. On the contrary, when the main body 10 is rotated clockwise, the second rolls 50 are driven by the main body 10, but cannot drive the driving member 30, such that the main body 10 idles clockwise.

Accordingly, the screwdriver rotation structure of the present invention has the following advantages.

1. The control member 20 is rotated on the main body 10, such that the driving member 30 is driven by the main body 10 to rotate in the anticlockwise direction only, in the clockwise direction only, and in the clockwise and anticlockwise directions, to perform three operation modes, thereby facilitating the user operating the screwdriver rotation structure.

2. When the second pillars 22 are detached and spaced from the first rolls 40 and the second rolls 50, the first rolls 40 and the second rolls 50 are located between the first face 111 and the peripheral face of the fifth pivot portion 31, such that the control member 20 is located at a position where the main body 10 and the driving member 30 cannot idle. Thus, the driving member 30 is driven by the main body 10 to rotate in the clockwise and anticlockwise directions.

3. When the control member 20 is rotated relative to the main body 10 anticlockwise, the fourth face 221 is moved to press each of the first rolls 40, such that each of the first rolls 40 is limited by each of the second pillars 22 and rests on one of the two second faces 121, such that each of the first rolls 40 is detached from the peripheral face of the fifth pivot portion 31 with a gap being formed therebetween. In such a manner, when the main body 10 is rotated clockwise, the second rolls 50 are driven by the main body 10 to drive and rotate the driving member 30 clockwise. On the contrary, when the main body 10 is rotated anticlockwise, the first rolls 40 are driven by the main body 10, but cannot drive the driving member 30, such that the main body 10 idles anticlockwise and cannot rotate the driving member 30.

4. When the control member 20 is rotated relative to the main body 10 clockwise, the fifth face 222 is moved to press each of the second rolls 50, such that each of the second rolls 50 is limited by each of the second pillars 22 and rests on one of the two second faces 121, such that each of the second rolls 50 is detached from the peripheral face of the fifth pivot portion 31 with a gap being formed therebetween. In such a manner, when the main body 10 is rotated anticlockwise, the first rolls 40 are driven by the main body 10 to drive and rotate the driving member 30 anticlockwise. On the contrary, when the main body 10 is rotated clockwise, the second rolls 50 are driven by the main body 10, but cannot drive the driving member 30, such that the main body 10 idles clockwise and cannot rotate the driving member 30.

5. The ball 60 is positioned in one of the positioning grooves 23, such that the control member 20 is located at three positions where the driving member 30 is driven by the main body 10 to rotate in the anticlockwise direction only, in the clockwise direction only, and in the clockwise and anticlockwise directions.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A screwdriver rotation structure comprising:

a main body, a control member, a driving member, a plurality of first rolls, a plurality of second rolls, a ball, an elastic member, and a screw member;

wherein:

the main body has a front end provided with a plurality of first recesses and a plurality of first pillars;

the first recesses are arranged between the first pillars, and have a number doubling that of the first pillars;

each of the first recesses has a first face having an arcuate shape or a planar shape;

each of the first pillars has two second faces;

each of the two second faces has an arcuate shape;

each of the first pillars has two third faces;

each of the two third faces is located at a connection of each of the first pillars and each of the first recesses;

each of the two third faces connects each of the two second faces and is located between each of the two second faces and the first face;

each of the two third faces has an arcuate shape;

each of the first pillars is provided with a first pivot portion which is located between the two second faces;

the first pivot portion of each of the first pillars has an arcuate face;

the main body has an interior provided with a through hole which has a circular shape and has a first length;

the through hole has a first end provided with a first fitting portion and a second end provided with a first abutting portion;

the first fitting portion is connected to the through hole and has a diameter greater than that of the through hole;

the through hole is located between the first fitting portion and the first abutting portion;

the first abutting portion has a planar shape;

the main body is provided with a plurality of second pivot portions;

each of the first pillars extends from each of the second pivot portions;

the second pivot portions have a number equal to that of the first pillars;

each of the second pivot portions is a protruding block and has a diameter greater than that of the first pivot portion;

one of the second pivot portions is provided with a receiving space having a circular shape;

the main body is provided with a plurality of second recesses each of which is arranged between two of the second pivot portions and aligns with two of the first recesses respectively;

the control member is pivotally mounted on and rotatable relative to the main body;

the control member is provided with a plurality of third pivot portions which are pivotally mounted on and rotatable relative to the second pivot portions;

the third pivot portions have a number equal to that of the first pillars;

each of the third pivot portions is a groove;

the control member is provided with a plurality of second pillars each movable between two of the first recesses;

each of the second pillars is arranged between two of the third pivot portions;

the second pillars have a number equal to that of the first pillars;

each of the second pillars has a fourth face, a fifth face, and a fourth pivot portion;

the fourth face and the fifth face are arranged symmetrically relative to each of the second pillars and have a convex shape;

the fourth pivot portion is located between the fourth face and the fifth face;

the fourth pivot portion has an arcuate shape and has a diameter equal to that of the first pivot portion;

the control member is provided with a plurality of positioning grooves, with the receiving space aligning with one of the positioning grooves when the control member is rotated relative to the main body;

the positioning grooves are connected to one of the third pivot portions;

the control member is provided with a plurality of projections received in the second recesses;

each of the projections is located between two of the third pivot portions;

each of the second pillars extends from each of the projections;

the projections have a number equal to that of the second pillars;

the control member is provided with a second abutting portion abutting the second pivot portions;

the driving member is pivotally mounted on the main body;

the driving member has a first end provided with a fifth pivot portion and a second end provided with a mounting portion;

the fifth pivot portion has a circular shape and aligns with the first recesses;

the first pillars are pivotally mounted in the fifth pivot portion;

the fifth pivot portion partially receives the main body and is pivotally mounted on the first pivot portion and the fourth pivot portion;

the driving member is provided with a first screw portion connected to the fifth pivot portion and aligning with the through hole;

the first screw portion is an internal thread;

the driving member is provided with a second fitting portion pivotally mounted in the first fitting portion;

the second fitting portion has a cylindrical shape and protrudes from a bottom of the fifth pivot portion;

the first screw portion is formed in the second fitting portion;

the mounting portion is connected to the first screw portion;

the first screw portion is located between the fifth pivot portion and the mounting portion;

the mounting portion is a polygonal recess;

each of the first rolls is received in one of the first recesses, and pivotally arranged between one of the first pillars and one of the second pillars;

the first rolls are pivotally mounted in the fifth pivot portion and have a number equal to that of the first pillars;

each of the first rolls has a cylindrical shape and rests between the first face and a peripheral face of the fifth pivot portion;

each of the first rolls is movable between one of the two second faces and the fourth face;

each of the second rolls is received in one of the first recesses, and pivotally arranged between one of the first pillars and one of the second pillars;

each of the first rolls and each of the second rolls are arranged between two of the first pillars;

each of the second pillars is arranged between one of the first rolls and one of the second rolls;

the second rolls are pivotally mounted in the fifth pivot portion;

the first pillars, the first rolls, the second pillars, and the second rolls are spaced and arranged annularly in the fifth pivot portion;

each of the second rolls has a cylindrical shape and rests between the first face and the peripheral face of the fifth pivot portion;

each of the second rolls is movable between one of the two second faces and the fifth face;

the second rolls have a number equal to that of the first pillars and that of the first rolls;

when the second pillars are spaced from the first rolls and the second rolls, the main body rotates the driving member clockwise and anticlockwise;

when the control member is rotated relative to the main body to press the first rolls or the second rolls, the main body rotates the driving member clockwise or anticlockwise;

when the control member is rotated relative to the main body anticlockwise, the fourth face is moved to press each of the first rolls, such that each of the first rolls is limited by each of the second pillars and rests on one of the two second faces, such that each of the first rolls is detached from the peripheral face of the fifth pivot portion with a gap being formed therebetween;

when the main body is rotated clockwise, the second rolls are driven by the main body to drive and rotate the driving member clockwise;

when the main body is rotated anticlockwise, the first rolls are driven by the main body, but cannot drive the driving member, such that the main body idles anticlockwise;

when the control member is rotated relative to the main body clockwise, the fifth face is moved to press each of the second rolls, such that each of the second rolls is limited by each of the second pillars and rests on one of the two second faces, such that each of the second rolls is detached from the peripheral face of the fifth pivot portion with a gap being formed therebetween;

when the main body is rotated anticlockwise, the first rolls are driven by the main body to drive and rotate the driving member anticlockwise;

when the main body is rotated clockwise, the second rolls are driven by the main body, but cannot drive the driving member, such that the main body idles clockwise;

the ball is received in the receiving space and positioned in one of the positioning grooves;

when the control member is rotated relative to the main body, the ball is positioned in one of the positioning grooves, such that the second pillars presses the first rolls, or presses the second rolls, or detach from the first rolls and the second rolls, such that the driving member is driven by the main body in the anticlockwise direction only, in the clockwise direction only, and in the clockwise and anticlockwise directions;

the elastic member is received in the receiving space and biased between the receiving space and the ball, such that the ball partially protrudes from the receiving space;

the screw member extends through the through hole and has a first end provided with a second screw portion and a second end provided with a head;

the second screw portion is an external thread that is screwed with the first screw portion;

the screw member has a shank extending through the through hole;

the shank is a round pole and is located between the head and the second screw portion;

the shank has a second length greater than the first length; and the head of the screw member rests on the first abutting portion.

2. The screwdriver rotation structure as claimed in claim 1, wherein the main body has six first recesses and three first pillars, and the control member has three third pivot portions and three second pillars.

3. The screwdriver rotation structure as claimed in claim 1, wherein the main body has a rear end provided with an assembly portion.

4. The screwdriver rotation structure as claimed in claim 1, wherein the driving member is pivotally mounted on the main body and the control member.

5. The screwdriver rotation structure as claimed in claim 1, wherein the screwdriver rotation structure has three first rolls.

6. The screwdriver rotation structure as claimed in claim 1, wherein the screwdriver rotation structure has three second rolls.

7. The screwdriver rotation structure as claimed in claim 1, wherein:

each of the first rolls is a round bead;

each of the first recesses is provided with two of the first rolls that are arranged linearly;

each of the second rolls is a round bead; and each of the first recesses is provided with two of the second rolls that are arranged linearly.

* * * * *